US005607252A

United States Patent [19]

Tischer

[11] Patent Number: 5,607,252

[45] Date of Patent: Mar. 4, 1997

[54] HIGHWAY COLLISION CONTAINMENT SYSTEM

[76] Inventor: Duain E. Tischer, 418 Village Rd., Hinsdale, Ill. 60521

[21] Appl. No.: 491,080

[22] Filed: Jun. 16, 1995

[51] Int. Cl.[6] ..... E01F 15/00

[52] U.S. Cl. ..... 404/6; 404/9; 256/13.1

[58] Field of Search ..... 404/6, 9, 10; 256/1, 256/13.1; 188/371, 377

[56] References Cited

U.S. PATENT DOCUMENTS 3,880,404 4/1975 Fitch ..... 256/13.1

5,374,137 12/1994 Steinberg ..... 404/9

5,429,449 7/1995 Baatz ..... 404/6

*Primary Examiner*—Henry A. Bennett

*Assistant Examiner*—Pamela A. O'Connor

[57] ABSTRACT

An improved containment system is disclosed which absorbs the collision energy of a vehicle about to strike a hazard. In the system, a block of flexible foam material having near-perfect total recovery after compression is placed adjacent a hazard. A first side of the block faces toward anticipated oncoming vehicular traffic. A fabric sheath capable of withstanding a substantial collision shock covers the first side of the block. On a second side of the block there is a resilient support member which receives transmitted impact energy from the sheath and block.

11 Claims, 2 Drawing Sheets

HIGHWAY COLLISION CONTAINMENT SYSTEM

This invention relates to systems for absorbing the impact of a vehicle headed toward a collision with a highway obstruction such as a pillar supporting a bridge over the highway, or a wall, or a guardrail. More particularly, it relates to a system utilizing a block of foam material wrapped in a shock-resistant sheath. The block and sheath are arranged to accept and transmit the shock of the collision through a series of vehicle decelerating elements while at the same time providing a durable and easily maintained assembly which immediately resumes crash protection abilities.

BACKGROUND OF THE INVENTION

Several energy absorbing systems have been available, heretofore. U.S. Pat. No. 4,007,917, issued Feb. 15, 1977, discloses the attachment of a foam cushion layer to a rigid member such as a bridge supporting column. The attachment is done with an epoxy resin adhesive. The foam cushion may be covered by an overlying protective layer of a thermoplastic or thermosetting resin film such as MYLAR, TEDLAR or SARAN. These materials can be bonded to the cushion by various methods such as heat shrinking. Once the system suffers the impact of a crash, it must be rebuilt.

U.S. Pat. No. 3,880,404 issued Apr. 29, 1975, discloses another energy absorbing highway safety system. A group of containers, called "cells," are grouped together, each one having cylindrical walls of tough plastic material with sufficient strength to withstand rupture on impact. The lower section of each cylinder is filled with lightweight plastic foam, and the upper section is filled with a few hundred pounds of sand or other dispensable material. The group of cells is confined by a flexible belt made of tough, stiff material. Upon impact, the sand spurts upwardly and the cells and the belt collapse. Afterwards the belt and cells are pulled back into shape by a truck so that new sand can be put into the cells and the assembly reused.

U.S. Pat. No. 4,352,484, issued Oct. 5, 1982, discloses another energy absorbing apparatus for dissipating vehicular impact energy. Several honeycombed sheets with polyurethane foam in the cells are stacked inside a polyethylene box which protects them from moisture. The boxes are set in a row inside a telescoping U-shaped metal guardrail installed in front of an abutment. In a crash, the sheets cut into each other to absorb energy. Afterwards, the telescoping U-shaped guardrail is rebuilt and new boxes, filled with the special sheets, are set in place.

In U.S. Pat. No. 3,876,185, issued Apr. 18, 1975, blocks of silicone, rubber, or plastic foam are disclosed which are designed to be connected together, either by tongue and groove sides or by wires, ropes or chains passed through and around them. They form a resilient stack of blocks big enough to absorb vehicular impact by entrapping a colliding vehicle. Whole blocks can be reassembled and reused when the system is rebuilt after each accident.

Other crash containment systems utilizing plastic foam elements are illustrated in U.S. Pat. Nos. 3,704,861; 3,963,218; and 4,183,505.

The various drawbacks illustrated in the foregoing patented assemblies of destructible materials are overcome by the present invention.

It is one of the objects of this invention to provide an automobile collision energy absorbing system wherein the elements of the system are constructed and arranged to collapse as the impact of an automotive vehicle is absorbed and to substantially return to their original configuration with little or no help as soon as the vehicle which impacted them is removed.

It is another object of this invention to provide an automobile collision energy absorbing system wherein the elements of the system are constructed and arranged to accept the impact of a collision sequentially in order to avoid stopping a vehicle suddenly and to avoid destruction themselves in order to be immediately available to accept a further collision as soon as the vehicle in the first collision is cleared from the site.

It is another object of this invention to provide an automobile collision energy absorbing system wherein the elements of the system are easily arranged to conform to a wide variety of highway collision hazards while still providing a sequential absorption of the impact energy.

It is another object of this invention to provide an automobile collision energy absorbing system wherein substantially standard elements are used which may be obtained at minimum cost, wherein the labor cost for assembling the elements on site is very small due to the ease and simplicity of assembling the several elements and the few people needed for assembly, and wherein the cost of maintaining the elements in a functioning mode on site is practically nil because of the almost indestructible nature of the elements as well as their self-reformation characteristics.

SUMMARY OF THE INVENTION

The present invention is a cushioning device for absorbing the collision energy of an automotive vehicle accidentally proceeding toward a hazard. It comprises a first base member made of foam, a sheath of woven fabric covering a first side of that base member, and a resilient support member disposed against a second side of the first base member. The first base member is normally constructed of ceramic foam. It is positioned adjacent the hazard, and a first side faces toward oncoming vehicular traffic. The sheath of woven fabric which covers the first side is capable of withstanding a substantial vehicle collision shock, usually without rupture of a majority of the strands in the fabric. The resilient support member disposed adjacent the second side of the first base member receives transmitted impact energy from the sheath and first base member when the sheath is struck by the vehicle.

This invention may take different forms. In one form, the first base member is a rectangular foam block covered by the woven fabric sheath on the side facing toward the traffic. This assembly may be mounted against a resilient support member such as a pair of horizontally disposed steel bars, preferably made of spring steel, fastened to upright supporting posts which are themselves mounted in resilient foam blocks in the ground.

A second form of the invention may have a first base member which is a foam cylinder. It is wrapped in a woven fabric sheath. This assembly may be faced toward oncoming traffic and backed against several other similarly wrapped foam cylinders. The force of an impact on the outwardly facing sheath of the first foam cylinder is transmitted to the body of cylinders backing up the first one.

Other aspects and advantages of this invention will be apparent from an examination of the accompanying drawings and following detailed description.

DETAILED DESCRIPTION OF THE PREFERRED EMBODIMENTS

Figure 1:
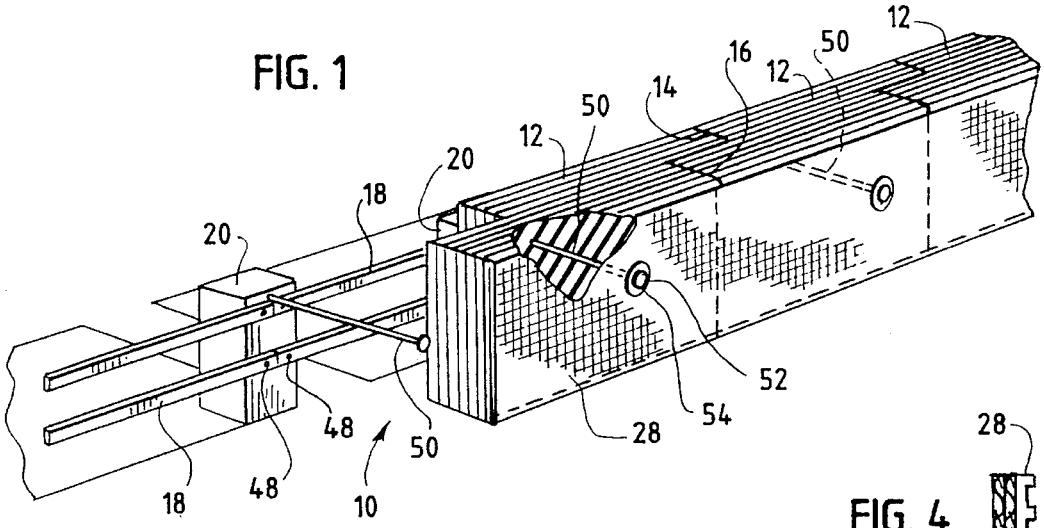
FIG. 1 is a perspective view, partially broken away, of one embodiment of the invention, illustrating a series of foam blocks arranged end to end in an interlocking manner with a fabric sheath over one side of them facing oncoming traffic and having fastening cables passing through them holding them against horizontally disposed bars and vertical supporting posts.

The cushioning device 10 shown in FIG. 1 includes a chain of foam blocks 12 which may be called first base members and which have interlocking end portions 14 and 16. The blocks are fastened with their ends interlocking lengthwise to horizontally disposed bars 18 and vertical posts 20 which resiliently support the blocks 12. The lower portions of the posts 20 are held in a below grade mounting assembly 22 (see FIG. 5) comprising a shell 24 filled with a foam packing 26. The foam packing conforms to the inner bounds of the shell and the lower end portion of post 20 inside the shell.

Figure 2:
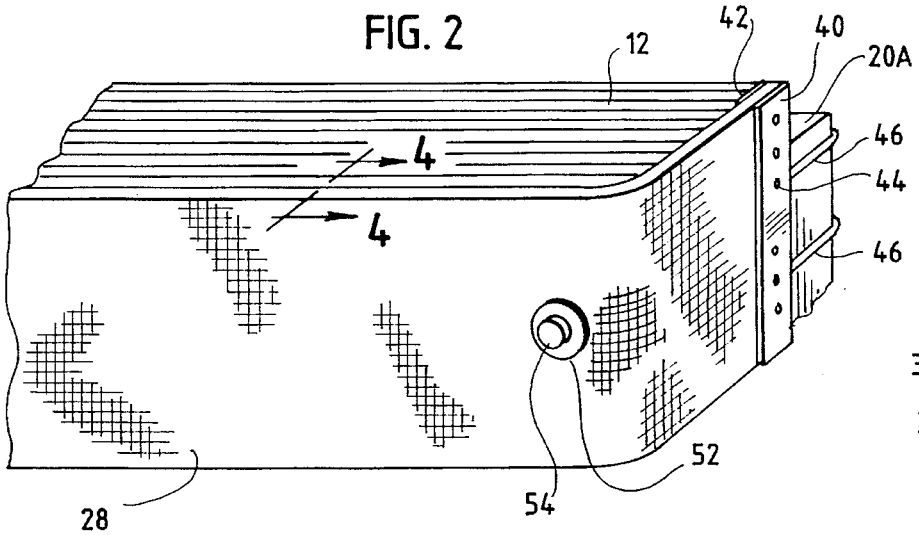
FIG. 2 is an enlarged perspective view of a portion of one end of the embodiment of the invention shown in FIG. 1 illustrating one end of the fabric sheath partially shown in FIG. 1 disposed about a foam block and fastened to a post.

The first side of each of the blocks 12 which faces oncoming traffic is covered by a fabric sheath 28 as shown in FIG. 2. The sheath 28 covers the first side of each of the blocks 12 in the chain. Preferably, the fabric is a combination of fibers and a rubber composition. The fibers preferably should be strong, tough, and elastic synthetic polyamide materials commonly known as NYLON. They are fashioned into strands and then woven together into a web. The rubber is preferably carboxylated nitrel rubber. The web is bonded to the rubber composition in a process which causes the fabric to take up a substantial amount of the rubber. There is a predominance of the NYLON web in one side of the combination in order to form a substantially smooth, strong fabric surface and a predominance of the rubber adjacent the NYLON web which may be shaped into protuberances in order to form a coarse, nubby surface on the other side of the combination.

Figure 4:
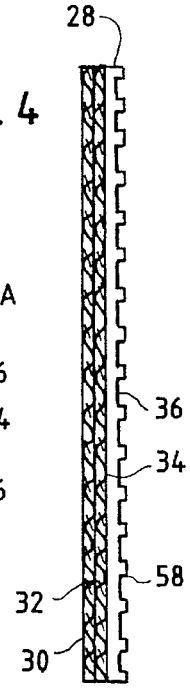
FIG. 4 is an enlarged sectional view of the fabric sheath showing in FIGS. 1–3 taken in the direction of arrows 4—4 in FIG. 2.

The material forming the fabric sheath 28, just described, has been manufactured by the Burrell Belting Company, in Skokie, Ill., under the designation 200 RT. A cross-section of the sheath is shown in FIG. 4. As seen in that Figure, the face 30 of the sheath 28 is relatively smooth, being formed by the NYLON web 32 which has become substantially impregnated with the rubber composition 34. The face 36 includes a large number of nubs 38 (only some of which are numbered in the drawing to avoid confusion) in order to provide a face which is coarse and spiked.

Foam blocks 12, which the sheath 28 is wrapped around (see FIGS. 1 and 2), are formed of foam panels which are preferably nine feet long, four feet high and about two inches thick. The blocks are built to their required thickness, by placing the broad faces of the panels together, as shown. While the panels are easier to handle, the blocks may also be molded as one unit of any thickness. Such thickness may be determined according to the size and speed of the vehicles anticipated in any chosen environment, such as a highway or racetrack, where the new collision containment system of this invention is to be installed. For a normal highway installation, where frequently metal guardrails are seen today along highways having interstate traffic travelling approximately sixty-five miles per hour, the blocks 12 will usually be about three feet thick.

The manner of affixing the fabric sheath 28 around the chain of blocks 12 is shown in FIGS. 1 and 2. If desired, the entire chain may be divided into sections, and each section covered with a separate sheath, but the manner of assembly is the same. A pair of steel plates 40 and 42 are fastened onto one end of sheath 28 by bolting them together through the sheath using bolts 44. The bolts may be about one and one-fourth inch long by seven-sixteenths inch in diameter. NYLOCK nuts are used to prevent loosening. An end post 20A, identical to the posts 20, disposed at one end of the row of blocks, has connector bolts on its rear side (not shown) to which cables 46 attached to plate 40 may be engaged. The opposite end of sheath 28 (not shown) may be similarly fastened to another end post like 20A, and the sheath drawn taut against the line of foam blocks 12 between the end posts. The smooth side 32 of the sheath faces outwardly and away from the blocks 12, and the nubbed face 36 is turned against the blocks. Thus, when a vehicle comes in contact with the sheath, the vehicle will slide along the sheath but the sheath will not slide along the blocks due to engagement of the nubbed face 36 on the blocks.

One form of the sheath may be one fourth inch thick by four feet wide ("high") by as long as needed to cover a line of foam blocks and still be engaged to posts at either end of the line. The construction of the sheath used in this invention has proven its strength and durability in belts used in the mining industry. Moreover, it has a tensile strength of over two thousand pounds. Covering the foam blocks with a sheath of this material prevents them from being cut or damaged in any way during a vehicle impact.

Preferably the foam panels 12 which are used in this invention are of a material identified as ETHAFOAM brand polyethylene foam made by The Dow Chemical Company. There are several varieties of this material, but the one which offers particularly desirable qualities is known as "ETHAFOAM 220 Plank." It gives a compressive strength in the vertical direction of seven to seventeen pounds per square inch, using ASTM D 3575 Test B. Its average density is 2.2 pounds per cubic foot, using ASTM D 3575 Test C, Method B. The foam has a near-perfect total recovery after compression.

The foam blocks and sheath are assembled, as noted above, with a second side of the blocks disposed upon a supporting system which includes posts 20 and bars 18 arranged horizontally on the posts. The bars should be approximately one-fourth inch thick, four inches wide and twenty feet long. Preferably they are made of spring steel or a similar strong and flexible material. Two bars are connected to every four posts, one about one foot from ground level and one very close to the top of each post 20. The bars are attached to the posts with eleven inch carriage bolts 48. The nuts used to fasten the carriage bolts 48 in place (not shown) are preferably NYLOCK lock nuts so that they will not loosen. However, they are not tightened fully. The lock nuts should only be snugged down so that the series of posts 20 connected by the bars, and the bars as well, can move together substantially as a unit in one direction and also return together to their original position as will be more fully explained below.

Figure 3:
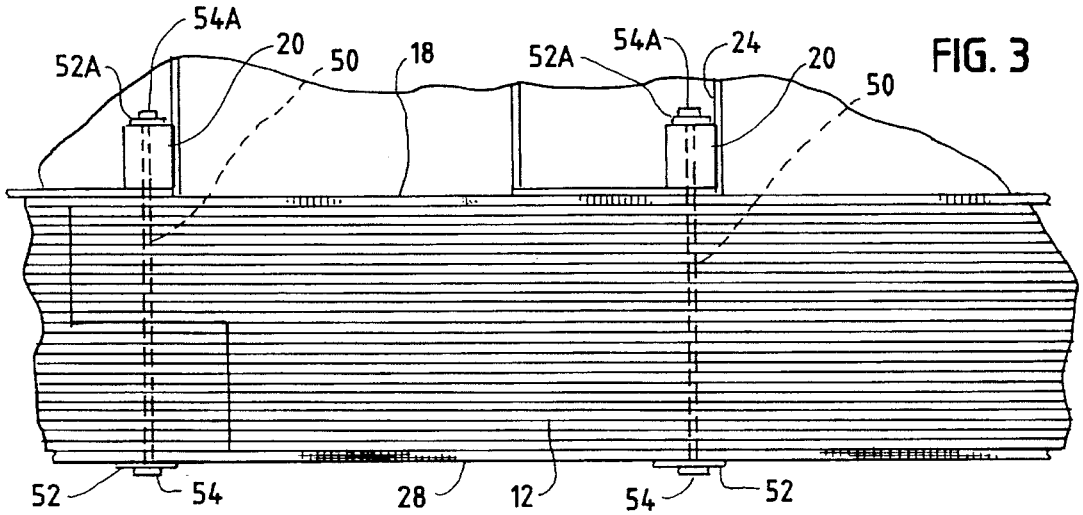
FIG. 3 is an enlarged top plan view of a portion of the embodiment of the invention shown in FIG. 1.

Posts 20 including end posts 20A, support the foam blocks 12 and sheath 28 by having those elements attached to them by means of cord segments 50. Preferably the cords are steel cables. They are normally about five sixteenths inches in diameter. They are inserted through the posts and the blocks by first drilling holes, and then pushing the cables through. When the end of a cable 50 issues from the hole in the sheath, a centrally apertured aluminum plate 52 approximately eight inches in diameter and an eighth of an inch thick is placed over it. The plate 52 is secured against the sheath by crimping a lead lock ferrule 54 onto the cable end. The sheath and block are pushed against the steel bars 18 and post 20 from which cable 50 issues, and the cable is pulled taut. Another plate 52A and ferrule 54A are fastened onto the cable in back of the post to keep the cable taut and hold the sheath and block assembly against the steel bars and post as shown particularly in FIG. 3.

Figure 5:
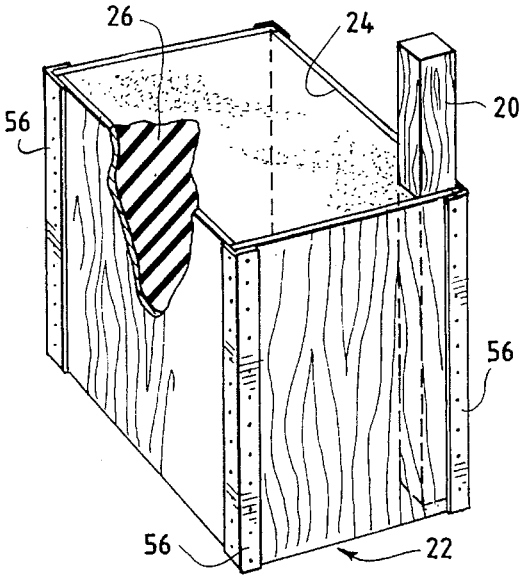
FIG. 5 is an enlarged view of a supporting post shown in FIG. 1 and the below grade mounting assembly, partially broken away, which holds the supporting post upright.
Figure 7:
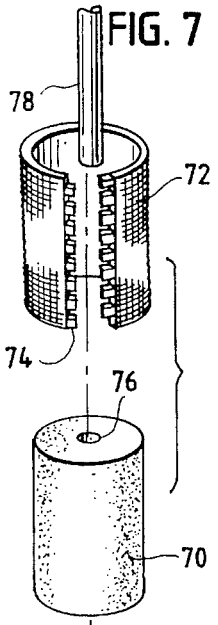
FIG. 7 is an exploded view of an element of an alternative embodiment of the invention showing a cylindrically shaped foam block centrally apertured in a vertical direction to receive a supporting post and also showing a fabric sheath disposable around the outside of the foam block.
Figure 6:
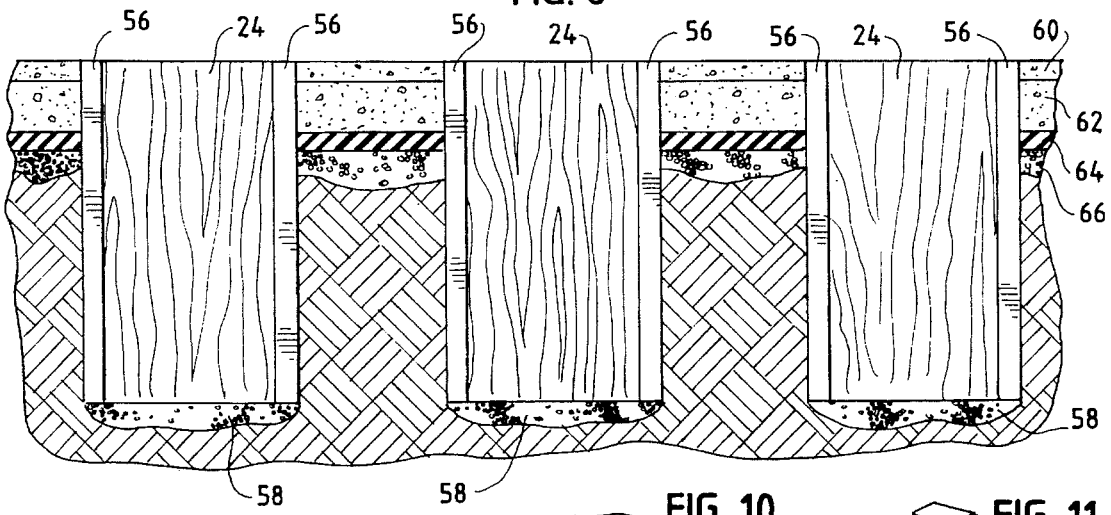
FIG. 6 is an elevational view of the below grade mounting assembly shown in FIG. 5 arranged in series with other identical below grade mounting assemblies for holding a plurality of supporting posts upright in the embodiment of the invention shown in FIG. 1.

The lower portions of the posts such as post 20 are disposed in below grade assemblies consisting principally of the foam filled shells 24 (see, FIGS. 5 and 6). The shells are located in holes approximately three feet wide and four feet long; they are at least four feet deep spaced in the ground every five feet from center to center (see FIG. 6). The shells may be made of three quarter inch thick plywood which has been treated with a preservative. Preferably they are built to contain a volume of foam packing 26 which is generally three feet by four feet by four feet. When a shell 24 is placed in a hole, with its top edge even with the surface of the ground around the hole, a post 20 is lowered into it at the front corner which is closest to expected collision traffic. As shown in FIG. 5, this is the right front corner of the shell. The post 20 is similar to a railroad tie and may measure approximately eight inches by 10 inches by seven feet long. Its lower end extends the depth of the shell, namely, four feet, leaving the upper end three feet above ground.

When the lower end of post 20 is in place inside shell 24, the shell is then packed firmly with ETHAFOAM foam having substantially the same characteristics as the foam in blocks 12. The disposition of the post at the front corner of the shell closest to the expected collision traffic permits the post to accept the energy of an impact and move substantially laterally as well as somewhat rearwardly against the foam in the shell. Such movement by the post dampens and absorbs still further the initial energy which a collision vehicle imparts to the sheath 28 and blocks 12.

The foam which is preferred for use in the present invention has near-perfect recoil memory. When the sheath 28 and blocks 12 are struck by a vehicle, they resist and absorb the impact. In addition, because the smooth side of the sheath 28 faces outwardly, a vehicle striking it at even a slight angle tends to slide along it rather than break or tear it. Further, any impact is transmitted to the steel bars 18 through the foam blocks 12, and the bars then distribute the energy of the impact to the several posts which the bars connect. As noted above, each post moving in its foam packing 26 further absorbs the energy of a collision. When the impact is over and the collision vehicle is removed from contact with the system, the foam blocks 12 and the foam packing 26 recoil to their original positions and return all of the elements of the system almost immediately to their original functional state.

All of the elements of the system are either very resistant to all forms of deterioration themselves or are treated or built to be so. The plywood from which the shells 24 is made is treated with a long term preservative. Corner reinforcing strips 56 are provided on the shells. The environment around the holes is prepared for permanence. As shown in FIG. 6, the bottoms of the holes contain a layer of stones 58 for drainage, and closer to the grade surface around the holes there is a layer of asphalt paving 60, a layer of concrete 62, a sand base layer 64 and a stone aggregate layer 66 on top of the earthen layer 68 in which the holes are dug. The sheath 28 is long lasting and has a tensile strength of about 2000 pounds per inch of sheath width, strong enough to withstand the impact of large tractor trailer trucks without any substantial rupture of the fabric strands. The ETHAFOAM foam is weather resistant, has low water absorption and chemical resistant properties, has no nutritional value to attract rodents or pests, and is anti-static, to name only some of its attributes.

Figure 8:
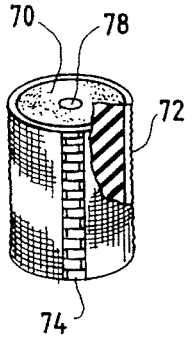
FIG. 8 is a perspective view of the cylindrically shaped foam block and fabric sheath shown in FIG. 7 in an assembled relation and partially broken away.

A second preferred embodiment of the present invention is shown in FIGS. 7 through 11. A foam block 70 is provided which has a cylindrical shape. A fabric sheath 72 forms an outer member which is fitted snugly around the block 70, and a piano-type hinge 74 joins the ends of the sheath. A hole 76 is formed in the block 70 along the centrally located longitudinal axis of the block. A post 78 which fits the hole 76 is provided for staking the block 70 and its accompanying sheath to the ground adjacent a hazard. FIG. 8 illustrates the relationship of these elements when they are assembled. The block 70 is made from the same ETHAFOAM foam as block 12 which was described above, and the fabric sheath 72 is made from the same NYLON and carboxylated nitrel rubber combination also described above.

Figure 9:
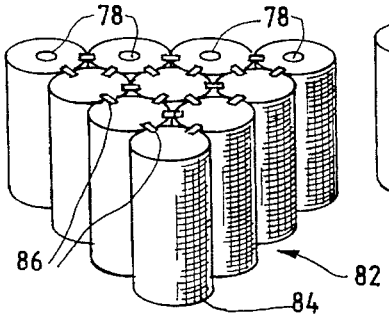
FIG. 9 is a perspective view of a grouping of cylindrical block assemblies which includes the cylindrically shaped block in FIG. 8 arranged with other identical blocks having vertical posts running through them and with other similarly shaped blocks without vertical posts.

A triangular grouping 82 of cylindrical block assemblies is shown in FIG. 9; however such a grouping may be organized in any other configuration which may be suitable for disposition in front of a hazard. The grouping 82 in FIG. 9 is an organization of some cylindrical blocks which are held in place by the posts 78 and of other, very similar assemblies 84 having foam blocks situated inside fabric sheaths but without axial posts to keep them staked in place. The assemblies 84 have foam materials in their cylindrical blocks and sheath materials surrounding the blocks which are identical to the materials in the assemblies in FIG. 8. The entire grouping 82 is interconnected by joining adjacent sheaths together with elongate clips 86 preferably made of spring steel or similar material, which are slipped over the sheaths wherever they are contiguous in the grouping 82.

Figure 11:
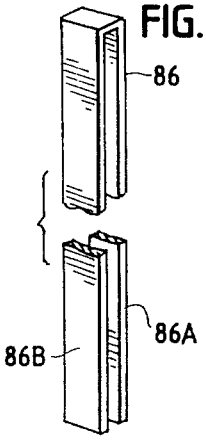
FIG. 11 is an enlarged perspective view, partially broken away, of a fastening member in the form of an elongated clip disposable over the sheaths of adjacent foam blocks in FIGS. 9 and 10 to keep them assembled together.

A preferred form of clip 86 is illustrated in FIG. 11. It has a pair of long slender parallel arms 86A and 86B which extend from a yoke located at one end of the arms. The arms slip over contiguous portions of the sheaths, between the sheaths and the foam blocks which the sheaths surround.

In the grouping 82, the row of assembled cylindrical blocks with posts 78 in them is backed up against a highway hazard (not shown) and maintained in place by the posts. Forwardly of the assemblies containing posts, that is, in the direction of anticipated collision traffic, there is a group of assemblies 84 cooperatively arranged to transmit impact energy away from a collision on the assemblies 84 to the supporting assemblies with posts. If the collision occurs head on with the block at the apex of the group of blocks in FIG. 9, the energy of the impact will be transmitted through successive sheaths and cylindrical foam blocks to the row of assemblies with posts, and if the collision occurs at a somewhat different angle than head on, the energy imparted by the collision will be transmitted in varying amounts to successive rows of assemblies. Also, if the collision is not head on, the collision vehicle will be diverted from the hazard by sliding along the sheath surfaces of successive assemblies. It should be noted, as well, that the cylindrical assemblies illustrated, due particularly to the tensile strength of the sheaths and to the recoil memory of the foam in the cylindrically shaped blocks, recover from a collision immediately and protect against further collisions without having to be serviced by highway maintenance personnel.

Figure 10:
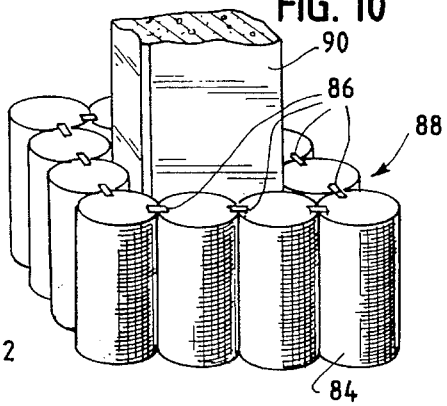
FIG. 10 is a perspective view of a further embodiment of the invention having cylindrically shaped blocks with fabric sheaths around them without central apertures for posts but fastened together about a hazard element such as a pillar.

A variation of the grouping 82 of assemblies 84 shown in FIG. 9 is illustrated in the grouping 88 in FIG. 10. A plurality of assemblies 84 are arranged around a highway hazard such as concrete pillar 90. The assemblies are joined together with clips 86, the same way as in FIG. 9. The energy initiated in a collision impact is transmitted from one assembly 84 to another in grouping 88 in the same manner as impact energy is transmitted to successive assemblies in grouping 82.

The invention embodiments described above may be embraced in other specific forms without departing from the invention's spirit or essential characteristics. The present embodiments are, therefore, to be considered in all respects as illustrative and not restrictive, the scope of the invention being indicated by the claims rather than by the foregoing description. Accordingly, all changes which come within the meaning and range of the equivalents of the claims are intended to be covered therein.

I claim:

1. A cushioning device for absorbing the collision energy of an automotive vehicle accidentally proceeding toward a hazard, comprising at least one first base member positionable adjacent the hazard and constructed of plastic foam having near-perfect total recoil memory recovery after compression and having a first side facing toward anticipated oncoming vehicular traffic, a fabric sheath capable of withstanding a substantial vehicle collision shock covering the first side of the first base member, and a resilient support member disposed adjacent a second side of the first base member to receive transmitted impact energy from the sheath and first base member when the sheath and first base member are struck by the vehicle.

2. A cushioning device for absorbing the collision energy of an automotive vehicle accidentally proceeding toward a hazard, comprising at least one first base member positionable adjacent the hazard and constructed of plastic foam having near-perfect total recovery after compression and having a first side facing toward anticipated oncoming vehicular traffic, a fabric sheath capable of withstanding a substantial vehicle collision shock covering the first side of the first base member, the sheath having a nubbed inside surface contacting the first side of the first base member and a substantially smooth outside surface facing outwardly from the first base member, and a resilient support member disposed adjacent a second side of the first base member to receive transmitted impact energy from the sheath and first base member when the sheath and first base member are struck by the vehicle.

3. The cushioning device of claim 2 in which the first base member is substantially cylindrically shaped and the sheath is tubularly shaped and fitted around the first base member.

4. The cushioning device of claim 2 which includes a plurality of first base members and resilient support members, at least some of which are cylindrically shaped and have a central longitudinal axis lengthwise therein extending in the same direction as each of the other central longitudinal axes cylindrically shaped of the first base members and resilient support members, the sheaths being tubularly shaped and fitted around each of the cylindrically shaped members, and a plurality of clip members engaging the sheaths to each other and holding the cylindrically shaped base members together.

5. The cushioning device of claim 4 in which each of the cylindrically shaped members are disposed on end and the longitudinal axes in each of the cylindrically shaped members are arranged substantially upright and parallel to each other.

6. The cushioning device of claim 4 in which each of the clip members includes at least a pair of substantially parallel arm portions joined together at one end by a yoke, the arm portions of each clip member being engaged over the edges of the sheaths of adjacent cylindrically shaped members and extending for a substantial distance along the outer surfaces of the adjacent cylindrically shaped members inside their respective sheaths.

7. A cushioning device for absorbing the collision energy of an automotive vehicle accidentally proceeding toward a hazard, comprising at least a pair of first base members positionable adjacent the hazard and constructed of plastic foam having near-perfect total recovery after compression and having a first side facing toward anticipated oncoming vehicular traffic, the pair of first base members being arranged in a chain and having interlocking end portions engaged with each other, a fabric sheath capable of withstanding a substantial vehicle collision shock covering the first side of each of the first base members in the chain, and at least one resilient support member disposed adjacent a second side of the first base members to receive transmitted impact energy from the sheath and first base members when the sheath and first base members are struck by the vehicle.

8. The cushioning device of claim 7 in which the resilient support member comprises at least a pair of horizontally positioned steel bars and spaced-apart posts supporting the bars.

9. The cushioning device of claim 8 in which a plurality of cord segments extend through the sheath and base members and tie the sheath and base members against the steel bars.

10. The cushioning device of claim 8 which includes a post anchoring means for each post comprising a shell member sunk into the ground surrounding a lower end portion of a post, and a plastic foam block member conforming to the lower end portion of the post within the shell and to any remaining space inside by the shell.

11. The cushioning device of claim 10 in which the lower end portion of each post is held against an inside corner of the shell by the foam block member.

* * * * *